US005319715A

United States Patent [19]

Nagami et al.

[11] Patent Number: 5,319,715

[45] Date of Patent: Jun. 7, 1994

[54] NOISE SOUND CONTROLLER

[75] Inventors: Masaaki Nagami, Akashi; Kazuya Sako, Kakogawa, both of Japan

[73] Assignee: Fujitsu Ten Limited, Hyogo, Japan

[21] Appl. No.: 934,652

[22] PCT Filed: May 26, 1992

[86] PCT No.: PCT/JP92/00680

§ 371 Date: Jan. 7, 1993

§ 102(e) Date: Jan. 7, 1993

[87] PCT Pub. No.: WO92/22054

PCT Pub. Date: Oct. 12, 1992

[30] Foreign Application Priority Data

May 30, 1991 [JP] Japan ..... 3-127632
Aug. 5, 1991 [JP] Japan ..... 3-195449

[51] Int. Cl.[5] ..... G10K 11/16
[52] U.S. Cl. ..... 381/71
[58] Field of Search ..... 381/71, 94

[56] References Cited

U.S. PATENT DOCUMENTS 5,170,433 12/1982 Elliott et al. ..... 381/71

*Primary Examiner*—Forester W. Isen
*Attorney, Agent, or Firm*—Oliff & Berridge

[57] ABSTRACT

A noise sound controller being capable of following a sudden change in a noise period, includes a differential signal calculation means 5 that calculates a differential signal between an output from a sound wave-electric signal converter 2 and an output from an adaptive filtering means 6, a transfer characteristics simulation means 4 that is inserted between the adaptive filtering means 6 and the differential signal calculation means 5, and simulates transfer characteristics of a system from the adaptive filtering means 6 to the differential signal calculation means passing through the electric signal-sound wave converter 3 and the sound wave-electric signal converter 2, a period-detecting unit 7 that detects the noise period of noise from a noise source 1, a period-adjusting unit 8 that varies the period of an output signal from the differential signal calculation means 5 depending upon an amount of change in the noise period, and a period detect/control means (10) that changes filter coefficients of the adaptive filtering mens 6 depending on estimated change in the noise period.

6 Claims, 17 Drawing Sheets

Fig. 5
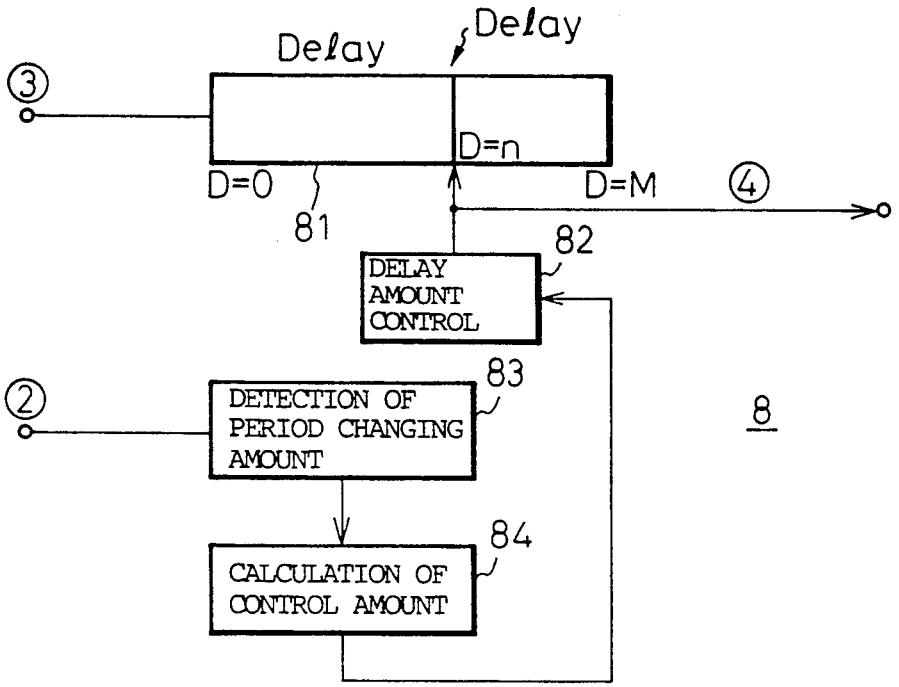
Fig. 6(a) ③
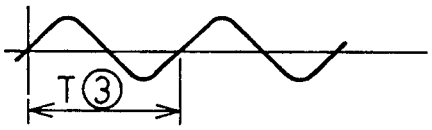
Fig. 6(b) ④
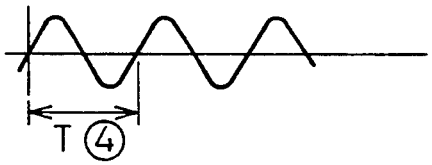

Fig. 8

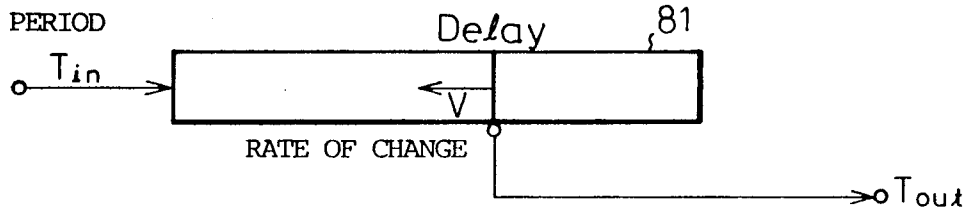

A when viewed as an absolute amount of change

| INPUT PERIOD $T_{in}$ (TAP) | RATE OF CHANGE V (TAP/SAMPLE) | OUTPUT PERIOD $T_{out}$ (TAP) |
|---|---|---|
| 30 TAPS | 1 TAPS/29 SAMPLES | 29 TAPS |
| ⋮ | 2 TAPS/28 SMAPLES | 28 TAPS |
| ⋮ | 3 TAPS/27 SMAPLES | 27 TAPS |
| ⋮ | ⋮ | ⋮ |
| ⋮ | 15 TAPS/15 SAMPLES | 15 TAPS |
| ⋮ | 16 TAPS/14 SAMPLES | 14 |
| ⋮ | ⋮ | ⋮ |

| | | |
|---|---|---|
| $T_{in}$ | $n/(T_{in}-n)$ | $T_{in}-n$ |

where $T_{out} = T_{in} - n$ n: AMOUNT OF SHIFTING THE PERIOD

B when viewed as a ratio of change

| $T_{in}$ (TAP) | V (TAP/SAMPLE) | $T_{out}$ (TAP) |
|---|---|---|
| 30 TAPS | 1/9 TAPS/SMAPLES | 9/10 · 30 TAPS |
| ⋮ | 2/8 TAPS/SAMPLES | 8 10 · 30 TAPS |
| ⋮ | ⋮ | ⋮ |
| ⋮ | 5/5 TAPS/SAMPLES | 5/10 · 30 TAPS |
| ⋮ | 6/4 TAPS/SAMPLES | 4/10 · 30 TAPS |
| ⋮ | ⋮ | ⋮ |

| | | |
|---|---|---|
| $T_{in}$ | 10-K/K | $K/10 \cdot T_{in}$ |

where $T_{out} = K/10 \cdot T_{in}$

NOISE SOUND CONTROLLER

DESCRIPTION

1. Technical Field

The present invention relates to a noise sound controller that erases a noise sound by outputting from a speaker a compensation sound that has a phase opposite to and a sound pressure equal to those of the noise sound that is detected by a microphone; the noise sound controller being capable of following even a sudden change in the frequency of the noise sound.

2. Background Arts

Passive silencer devices such as mufflers have heretofore been used to suppress the noise sound generated by internal combustion engines, leaving, however, much room for improvement from the standpoint of size and silencing characteristics.

To overcome these shortcomings there has been proposed an active noise sound controller that outputs, from a speaker, a compensation sound that has a phase opposite to and a sound pressure equal to those of a noise sound generated from a noise source, in order to eliminate the noise sound.

However, putting the active noise sound controllers into practical use has been delayed because of insufficient frequency characteristics or stability thereof.

Owing to the development in recent years of signal processing technology using digital circuitry enabling a wide range of frequencies to be treated, however, many practical noise sound controllers have been proposed (see, for example Japanese Unexamined Patent Publication No. 63-311396).

The above publication discloses an active noise sound controller of the so-called two microphones and one speaker type consisting of a combination of a feedforward system and a feedback system, in which a noise sound is detected by a microphone that is installed on the upstream side of a duct to pick up the noise sound from a noise source, and is processed by a signal processing circuit and outputs, from a speaker installed on the downstream side of the duct, a signal that has a phase opposite to and a sound pressure equal to those of the noise sound, and the silenced result is detected by a microphone at a silencing point and is fed back.

On the other hand, in order to obtain a silencing effect in a space where the site of the noise source is ambiguous such as in the interior of an automobile, it is necessary to employ a device having a one-microphone one-speaker constitution using the feedback system only without installing a microphone at the noise source.

In the active noise sound controller constituted by one microphone and one speaker based on a feedback system only, however, the silencing effect decreases when the noise period of a noise source suddenly changes since the feedback system has a delay defect that is greater than the sound wave transfer characteristics from at least the speaker to the microphone.

In view of the above-mentioned problems, therefore, the object of the present invention is to provide a noise period controller that is capable of following a sudden change in the noise period.

DISCLOSURE OF THE INVENTION

FIG. 1 is a diagram illustrating the first principle and constitution of the present invention. In order to solve the above-mentioned problem, the present invention provides a noise sound controller having a sound wave-electric signal converter 2 that detects noise and converts it into an electric signal, and an electric signal-sound wave converter 3 that outputs a compensation sound wave to erase noise, wherein a noise period controller comprises a transfer characteristics simulation means 4, a differential signal calculation means 5, an adaptive filtering means 6, a period-detecting unit 7, and a period-adjusting unit 8.

The differential signal calculation means 5 calculates a differential signal between an output of the sound wave-electric signal converter 2 and an output of the adaptive filtering means 6.

The transfer characteristics simulation means 4 is inserted between the adaptive filtering means 6 and the differential signal calculation means 5, and simulates the transfer characteristics from the adaptive filtering means 6 to the differential signal calculation means 5 passing through the electric signal-sound wave converter 3 and the sound wave-electric signal converter 2.

The period-detecting unit 7 detects the noise period of the noise source 1.

The period-adjusting unit 8 varies the period of an output signal of the differential signal calculation means 5 depending upon the amount of change of the noise period. Based on the output signal from the period-adjusting unit 8 and the output of the sound wave-electric signal converter 2, the adaptive filtering means 6 calculates a compensation signal, with which the electric signal-sound wave converter 3 outputs a compensation sound wave. The adaptive filtering means 6 may directly input a signal that is obtained by adjusting the period of a noise signal from the noise source. In this case, the transfer characteristics simulation means 4 and the differential signal calculation means 5 may be omitted.

According to the noise period controller shown in FIG. 1, a noise signal is formed from a differential signal that is output by the differential signal calculation means 5 based on the output of the transfer characteristics simulation means 4 and the output of the sound wave-electric signal converter 2; the amplitude and phase are adjusted by the adaptive filtering means 6 that inputs the noise signal, and a compensation sound wave is output from the electric signal-sound wave converter 3 in response to the compensation signal, thereby canceling the noise. Furthermore, the period-detecting unit 7 detects the noise period to monitor a change in the noise period, and the period-adjusting unit 8 adjusts the output signal of the differential signal calculation means 5, i.e., adjusts the period of the input signal of the adaptive filtering means 6 depending on a change in the noise period. Therefore, the period of the compensation sound wave from the electric signal-sound wave converter 3 comes into agreement with the period of noise at the silencing point. Accordingly, even a sudden change in the noise period can be followed.

FIG. 2 is a diagram illustrating the second principle and constitution of the present invention. In order to solve the above-mentioned problem, the present invention provides a noise sound controller comprising an electric signal-sound wave converter 3 that erases a noise sound from a noise source 1, a sound wave-electric signal converter 2 that converts, into an electric signal, a residual sound of the noise sound erased by the sound wave from said electric signal-sound wave converter 3, and an adaptive filtering means 6 that sends a compensation signal for erasing the noise sound to said electric signal-sound wave converter 3 based on a signal from said sound wave-electric signal converter 2; the noise sound controller further comprising a period detect/control means 10 that changes the filtering characteristics of the adaptive filtering means 6 depending on an estimated change in the noise period.

The period detect/control means 10 detects the noise period of the noise source 1, estimates a change in the noise period, and newly sets multiplication coefficients that have been set in a plurality of multipliers included in said adaptive filtering means 6 depending on the estimated change in the noise period.

Moreover, the period detect/control means 10 detects the noise period of the noise source 1, estimates a change in the noise period, and moves output taps of a plurality of delay units that are included in the adaptive filtering means 6.

Furthermore, the period detect/control means 10 forms vectors of a plurality of dimensions, detects a change in the vectors, estimates the change thereof, and newly sets the multiplication coefficients of a plurality of multipliers included in the adaptive filtering means 6.

According to the noise sound controller shown in FIG. 2, the noise is erased since a compensation signal of the adaptive filtering means 6 that inputs a noise signal is adjusted in amplitude and phase in response to a differential signal between a noise from the noise source 1 and a sound wave from the speaker 3 having a phase opposite to and a sound pressure equal to those of the noise. When the noise period suddenly changes, the period detecting means detects a change in the noise period, estimates the change in the previous noise period by taking into consideration the transfer characteristics up to a silencing point via the electric signal-sound wave converter 3 and the like, and shifts and controls the multiplication coefficients of a plurality of multipliers that constitute the adaptive filtering means 6, so that the period of a compensation sound wave from the electric signal-sound wave converter 3 is in agreement with the period of noise at the silencing point. Therefore, even a sudden change in the noise period can be followed.

The same operation is obtained even when the taps of the delay units in the adaptive filtering means 6 are moved by the period detecting means 10.

Moreover, multiplication coefficients of multipliers in the adaptive filtering means 6 are obtained in the form of vectors by the period detecting means 10; the change in the vectors being intimately related to the noise period. Therefore, the noise period can be easily estimated by estimating the change in the vectors, and the period of the compensation sound wave can be brought into agreement at the silencing point by taking the transfer characteristics into consideration despite the sudden period changes.

BRIEF DESCRIPTION OF THE DRAWINGS

FIG. 5 is a diagram illustrating the constitution of the period-adjusting unit of FIG. 3;

FIG. 6 is a diagram illustrating a relationship of input and output signals of the period-adjusting unit of FIG. 5;

FIG. 8 is a diagram explaining the function of the delay amount control unit;

DESCRIPTION OF THE PREFERRED EMBODIMENTS

Embodiments of the invention will now be described in conjunction with the drawings.

Figure 3:
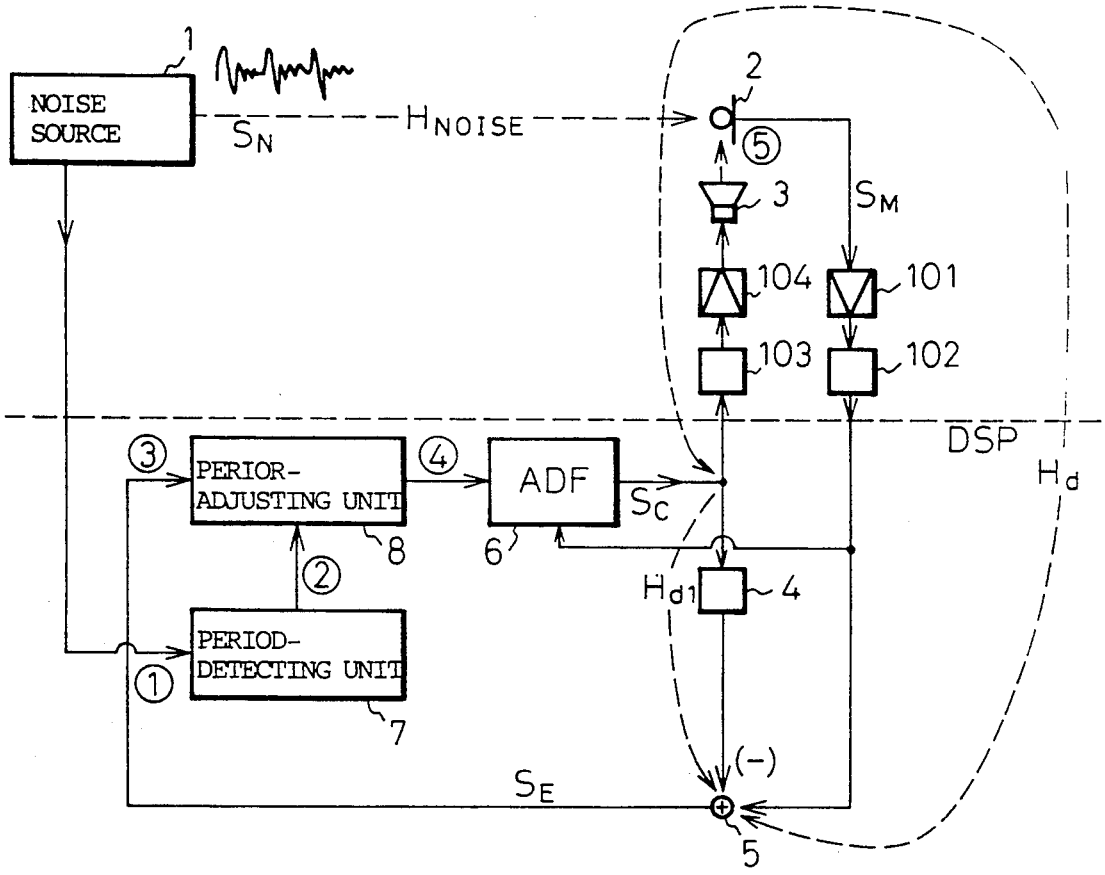
FIG. 3 is a diagram illustrating a noise period controller according to a first embodiment of the present invention.
Figure 4A:
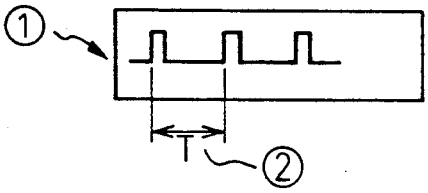
FIG. 4 is a diagram explaining a method of detecting the period by the period-detecting unit of FIG. 3.
Figure 4B:
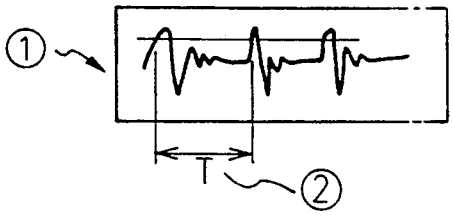
Figure 4C:
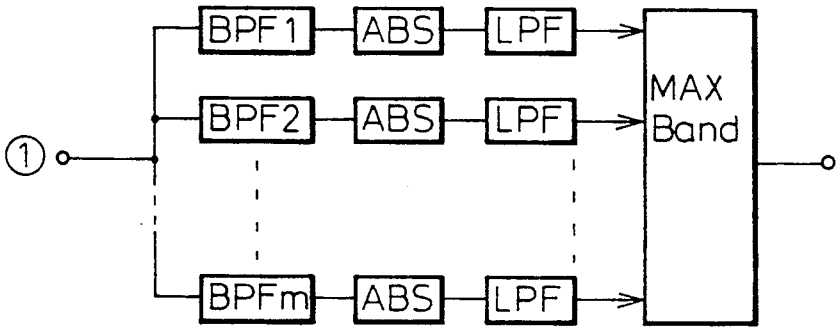
Figure 4D:
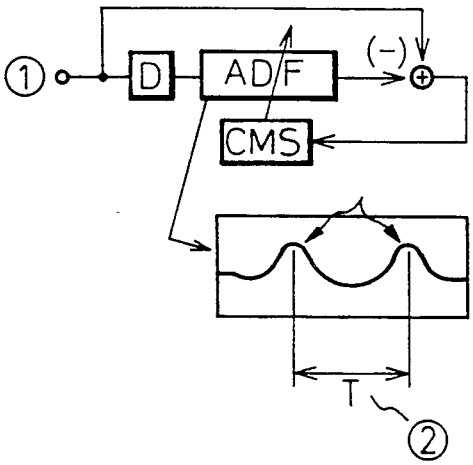

FIG. 3 is a diagram illustrating a noise period controller according to a first embodiment of the present invention. The constitution of this diagram will now be described. The constitution of this diagram comprises a noise source 1 such as an engine or a motor of an automobile, a microphone 2 that traps, near a silencing point, a residual sound canceling a sound wave propagated from the noise source 1 and converts the residual sound into an electric signal, a an error signal a speaker 3 that outputs the compensation sound wave to erase noise near the silencing point, a transfer characteristics simulation means 4 that simulates transfer characteristics of a system from the adaptive filtering means 6 to the differential signal calculation means 5 passing through the speaker 3 and the microphone 2, a differential signal calculation means 5 that calculates a differential signal between the output of the microphone 2 and the output of the transfer characteristics simulation means 4, an adaptive filtering means 6 that calculates a compensation signal based on a calculated result of the differential signal calculation means 5 to output a compensation sound wave from the speaker 3, a period-detecting unit 7 that detects the noise period of the noise source 1, a period-adjusting unit 8 that varies the period of an input signal to the adaptive filtering means 6 depending upon the amount of noise period change, an amplifier 101 for the microphone 2, an A/D converter (analog to digital converter) 1 that digitizes the output of the amplifier 102 and outputs it to the differential signal calculation means 5, a D/A converter (digital to analog converter) 103 that converts the output of the adaptive filtering means 6 into an analog value, and an amplifier 104 that amplifies the output of the D/A converter 103 and outputs it to the speaker 3. The adaptive filtering means 6 may be constituted by a band-pass filter, a delay unit and an amplifier.

Here, the transfer characteristics simulation means 4, differential signal calculation means 5, adaptive filtering means 6, period-detecting unit 7, and period-adjusting unit 8 are constituted by DSPs (digital signal processors).

FIG. 4 is a diagram explaining a method of detecting the period by the period-detecting unit of FIG. 3, wherein the diagram (a) explains a method of detecting the timing of rotation, such as an engine of an automobile, which is the noise source ①. A signal of a rectangular wave is input as designated at 1 to the period-detecting unit 7 where a period T is found and is output as designated to ② to the period-adjusting unit 8. In the case of an automobile, a sudden change in the noise is caused by a change in the number of revolutions of the engine of the automobile.

The diagram (b) explains the method of detecting the noise waveform by installing a microphone near the engine of the automobile in order to obtain a period T of a noise signal from the peaks in the time waveform when the timing signals are not obtained as shown in the diagram (a). In this signal processing, a rectangular wave is generated when the level of a noise signal has exceeded a predetermined level and is input to the period-detecting unit 7, thereby obtaining the period T in the same manner as in the diagram (a).

The diagram (c) explains a BPF (band-pass filter) peak detection method for finding a noise period T after a noise signal input to the microphone is digitized. This method comprises a plurality of band-pass filters 1, 2, - - - , n, absolute value units (ABS) connected to the band-pass filters 1, 2, - - - , n, averaging units (LPF) connected to the absolute value units, and maximum band-detecting units that detect maximum values of the averaging units, wherein a maximum frequency band of the noise level is detected and a period of the maximum frequency band is used as a period of a noise signal.

The diagram (d) explains a method of detecting the period using an adaptive filter comprising a delay unit (delay) that inputs a differential signal from the differential signal calculation means 5, an adaptive filter (ADF) that inputs the output from the delay unit, an adder unit that obtains a differential signal between the output of the adaptive filter and the input signal and a least-squares processing unit (LMS) that subjects the differential signal of the adder unit to the method of least squares to determine a coefficient of the adaptive filter. The period of a noise signal is found from a fixed coefficient of the adaptive filter.

FIG. 5 is a diagram illustrating the constitution of the period-adjusting unit of FIG. 3. The period-adjusting unit 8 diagrammed here includes a delay memory 81 that inputs the differential signal from the differential signal calculation means 5, has delay types of a number of M, and sends an output to the adaptive filtering means 6 from a delay point thereof, a delay amount control unit 82 that controls the amount of delay by moving the delay point of the delay memory 81, a period changing amount detecting unit 83 that detects the amount of change in the period based on the period data from the period-detecting unit 7, and a control amount calculation unit 84 that calculates the delay control amount that changes the delay point based on the amount of change in the period.

FIG. 6 is a diagram illustrating a relationship of input and output signals of the period-adjusting unit of FIG. 5, wherein the diagram (a) shows that the input signal to the delay memory 81 has a period T③ and the diagram (b) shows that the output signal of the delay memory has a period T④.

Figure 7:
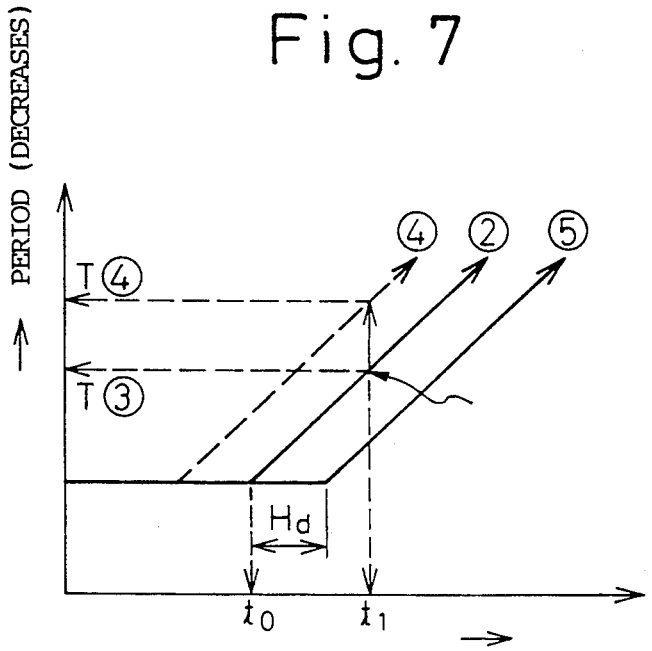
FIG. 7 is a diagram illustrating a relationship between the amount of change in the period and the calculated amount of control therefor.

FIG. 7 is a diagram illustrating a relationship between the amount of change in the period and the calculated amount of control therefor. If the period first remains constant and then decreases starting at a given moment ($t_0$), the amount of change in the period is detected by the period changing amount detecting unit 83 as represented by ② in the drawing. According to the prior art, on the other hand, the time is delayed by transfer characteristics Hd as represented by ⑤ at a position of the microphone 2. In order to simplify the description, the transfer characteristics are neglected in the signal processing units such as the adaptive filtering means 6 and the like. By taking the transfer characteristics Hd into consideration, the control amount calculation unit 84 calculates data to change the period at an early time as represented by a curve ④ in the drawing in contrast with the curve ②. In FIG. 6, a change in the period is represented by a straight line with respect to the time, which, however, may be represented by a curve. In such a case, a function is provided for the curve ④ and is found by fitting. In the thus obtained curve ④ of FIG. 6, an estimated period T④ is found for the period T③ of the present moment ($t_1$).

FIG. 8 is a diagram that explains the delay amount control unit, wherein the delay memory 81 successively receives the input signal data at a predetermined sampling period; the period Tin of the input signals and the period Tout of the output signals are displayed as being calculated as tap numbers, and the delay control unit 82 moves the delay point at a predetermined speed V in order to obtain output signals having the period Tout from input signals having the period Tin. In FIG. 6, the side A is for explaining the tap speed V that is viewed as an absolute amount of change. In order to make an input signal period Tin=30 taps into an output signal period Tout=29 taps, the taps are moved toward the input side at a speed of V=1 tap/29 samples. To make Tout=28 taps, the taps are moved at V=2 taps/28 samples. To make Tout=27 taps, the taps are moved at V=3 taps/27 samples. To make Tout=15 taps, the taps are moved at V=15 taps/15 samples. To make Tout=14, the taps are moved at V=16 taps/14 samples. To make an input signal period Tin into an output signal period Tout=Tin−n, in general, V should be n/(Tin−n) where n is the amount of shifting the period.

The side B is to explain the movement of the delay amount control unit that is viewed as a rate of change. The taps are moved at a speed of V=1/9 taps/sample to make an input signal period Tin=30 taps into an output signal period Tout=(9/10)×30 taps, moved at a speed of V=2/8 taps/sample to make Tout=(8/10)×30 taps, - - - , moved at V=5/5 taps/sample to make Tout (5/10)×30 taps, and moved at V=6/4 taps/sample to make Tout=(4/10)×30 taps, - - - . To make an input signal period Tin into an output signal period Tout=(k/10)×Tin, in general, V should be (10−k)/K, where k/10 is a rate of shifting the period.

Next, briefly described below is the adaptive filtering means. Strictly speaking, transfer characteristics of electric signals have to be taken into consideration which, however, have no direct relation to the present invention and are not discussed to simplify the description. The noise source 1 generates noise $S_N$, the transfer characteristics up to the microphone 2 are denoted by $H_{NOISE}$, the adaptive filtering means 6 produces a compensation signal Sc, the transfer characteristics of a system from the adaptive filtering means 6 to the differential signal calculation means 5 via the speaker 3 and the microphone 2 are denoted by Hd, and the transfer characteristics of the transfer characteristics simulation means 4 are denoted by Hdl. Here, if Hdl=Hd, then the signal $S_M$ output from the microphone 2 is expressed as $S_M=S_N \cdot H_{NOISE}+Sc \cdot Hd$. Therefore, the differential signal $S_E$ which is a result calculated by the differential calculation unit 5, is given by $S_E=S_M-Sc \cdot Hdl=S_M-Sc \cdot Hd=S_N \cdot H_{NOISE}$, i.e., the signal is calculated when the noise only is detected by the microphone 2. The differential signal $S_E$ is input to the adaptive filtering means 6 to calculate the compensation signal Sc with which $S_M$ becomes zero.

Figure 1:
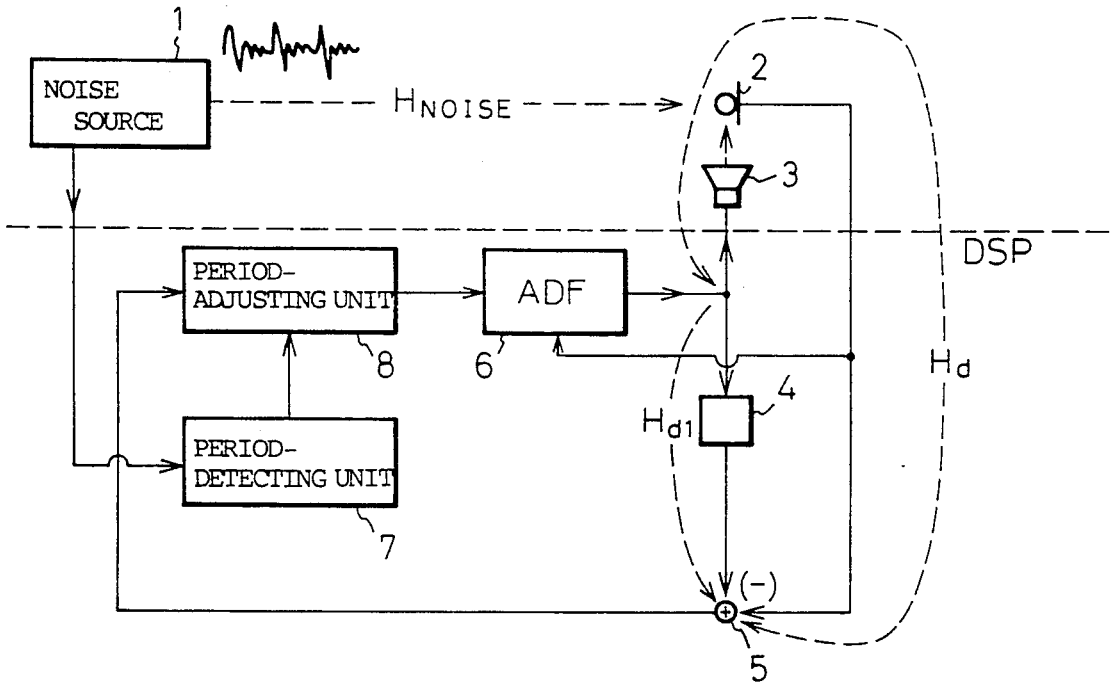
FIG. 1 is a diagram illustrating the first principle and constitution of the present invention.
Figure 2:
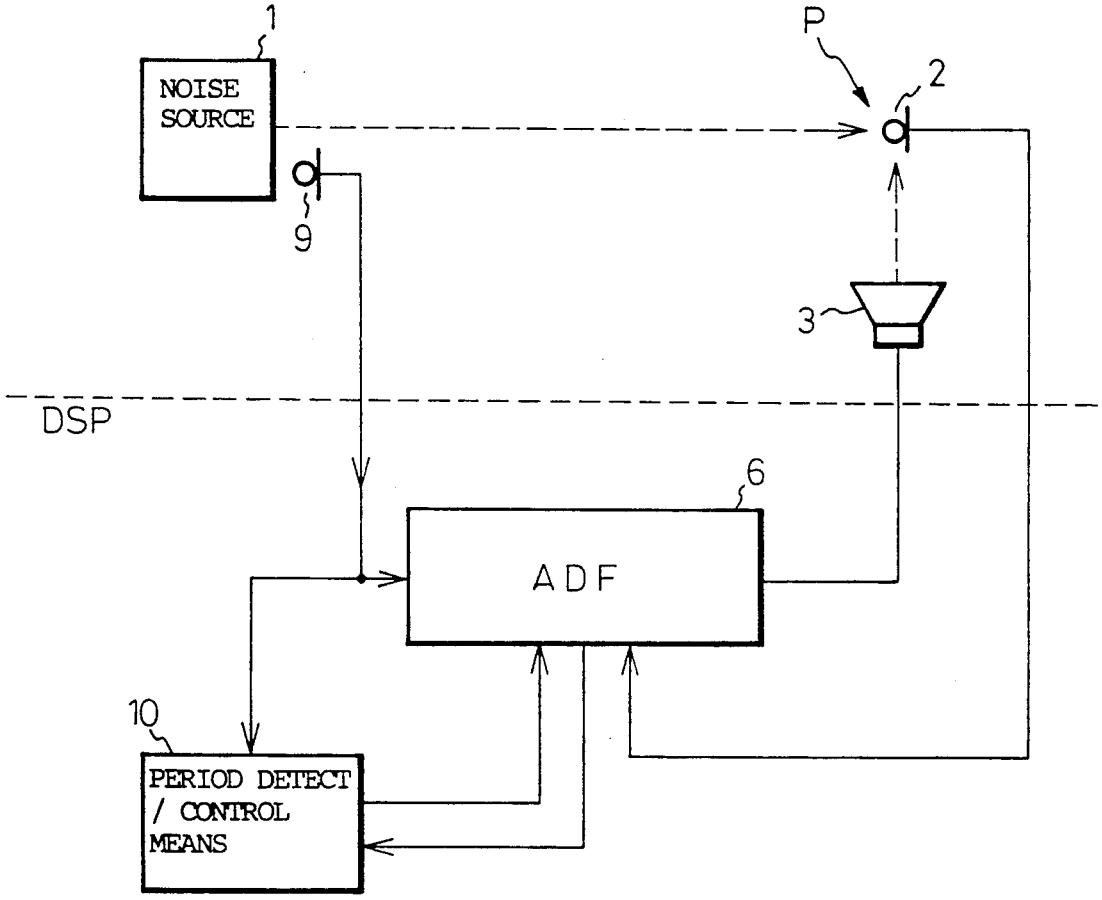
FIG. 2 is a diagram illustrating the second principle and constitution of the present invention.
Figure 9:
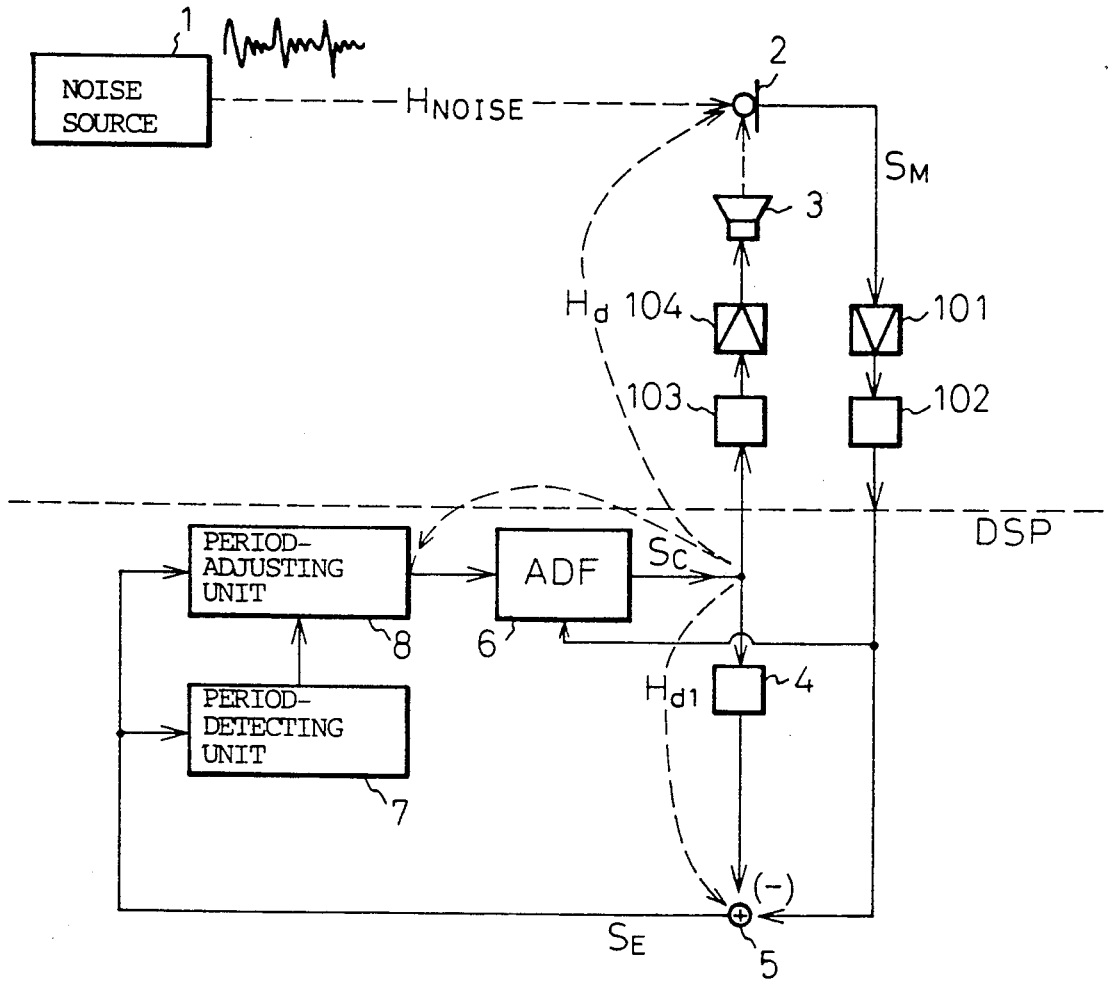
FIG. 9 is a diagram illustrating a noise period controller according to a second embodiment of the invention.

FIG. 9 is a diagram illustrating a noise period controller according to a second embodiment of the present invention. What makes the constitution of FIG. 9 different from that of the first embodiment of FIG. 2 is that the period-detecting unit 7 does not input signals of a detecting period from the noise source 1 but inputs a differential signal fed back from the differential signal calculation means 5; the differential signal also being input by the period-adjusting unit 8, because the control amount calculation unit 84 in the period-adjusting unit 8 has the function of predicting a change in the period, and hence the delay amount control unit 82 reproduces a compensation sound that corresponds to a period that is ahead by a delay quantity equivalent to the transfer characteristics Hd from the output of the period-adjusting unit 8 to the silencing point of the microphone 2 via the speaker 3.

Figure 10:
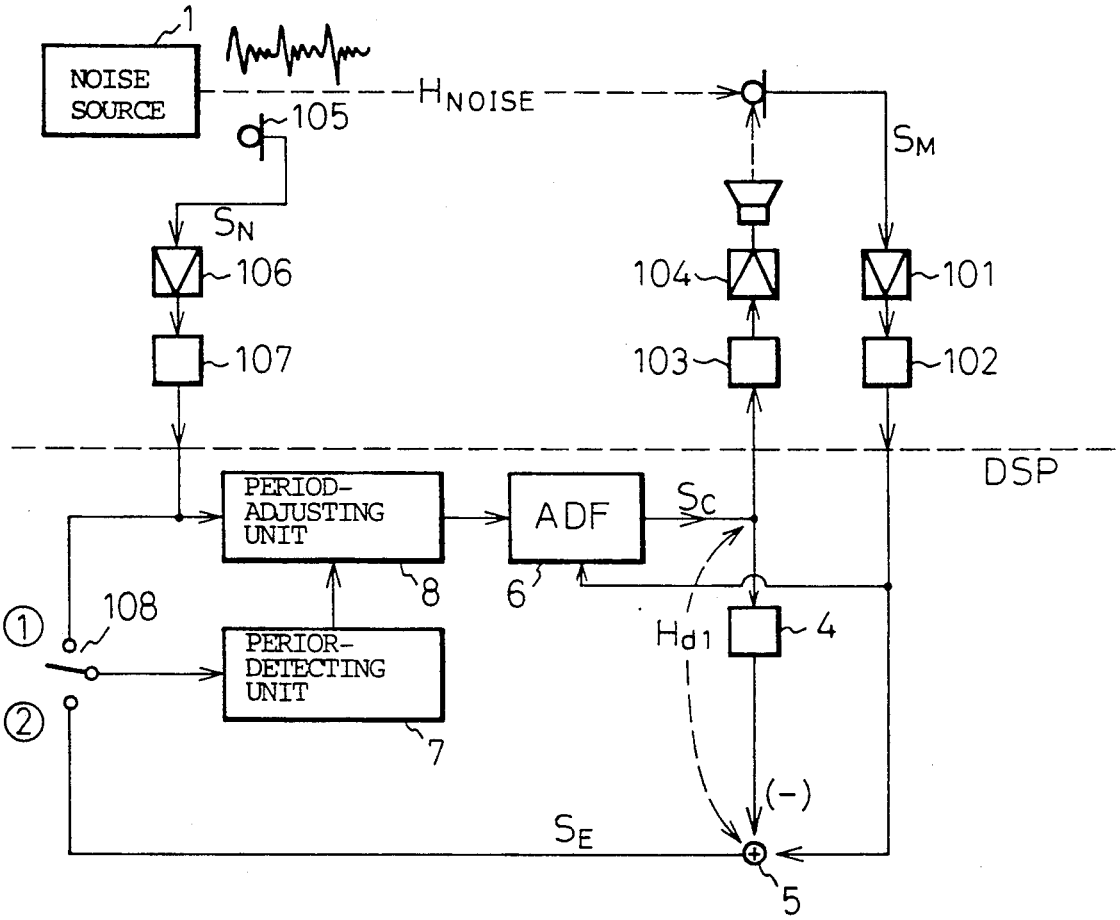
FIG. 10 is a diagram illustrating a noise period controller according to a third embodiment of the present invention.

FIG. 10 is a diagram illustrating a noise period controller according to a third embodiment of the present invention. The constitution of FIG. 10 is different from that of the first embodiment of FIG. 3 with regard to the provision of a microphone 105 that directly picks up noise signals from the noise source 1, an amplifier 106 connected to the microphone 105, an A/D converter 107 that is connected to the amplifier 106 and forms an input to the period-adjusting unit 8, and a switching unit 108 that alternatively selects either one of the outputs from the A/D converter 107 or the differential signal calculation means 5 and inputs it to the period-detecting unit 7. That is, the same actions and effects as those mentioned above are obtained even when the noise signals from the noise source 1 are directly input to the period-adjusting unit 8, and either the A/D converter 107 or the differential signal calculation means 7 is input to the period-detecting unit 7.

Figure 11:
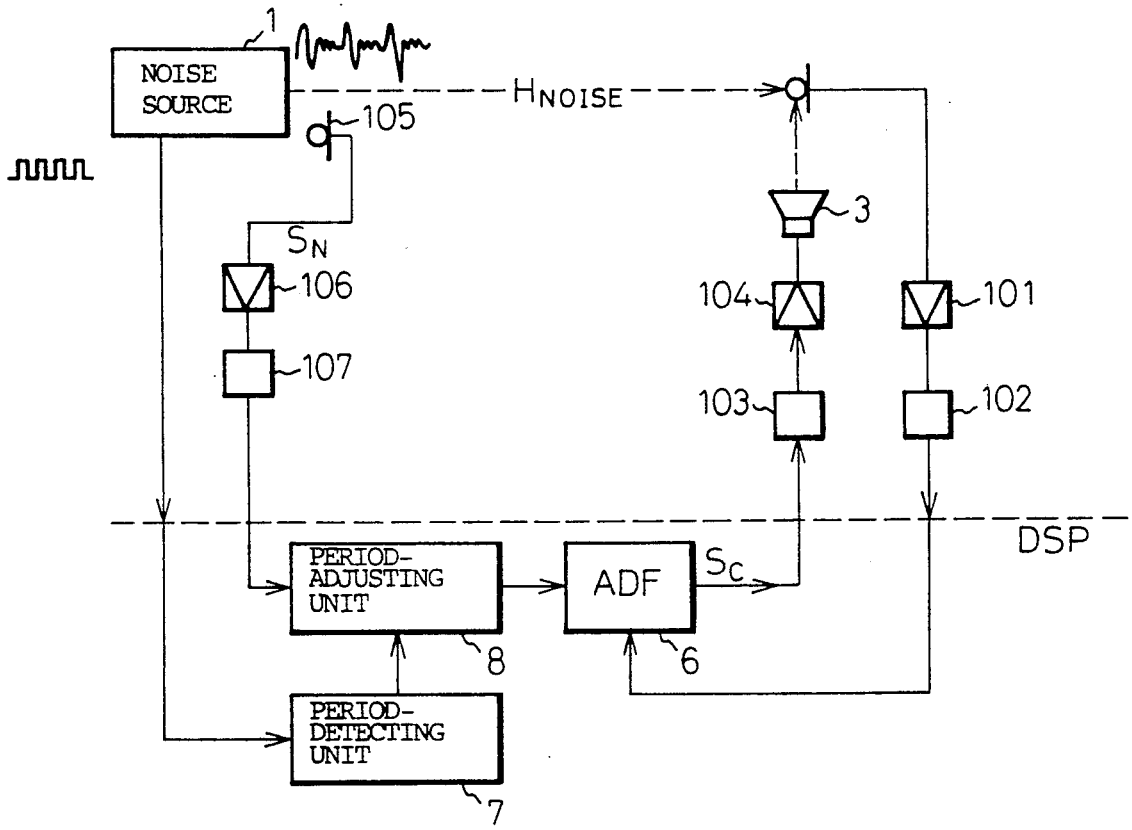
FIG. 11 is a diagram illustrating a noise period controller according to a fourth embodiment of the present invention.

FIG. 11 is a diagram illustrating a noise period controller according to a fourth embodiment of the present invention. The constitution of FIG. 11 is different from that of the third embodiment of FIG. 9 in that the timing signals from the noise source 1 are input to the period-detecting unit 7. This constitution makes it possible to obtain the same actions and effects as those that were described above.

Figure 12:
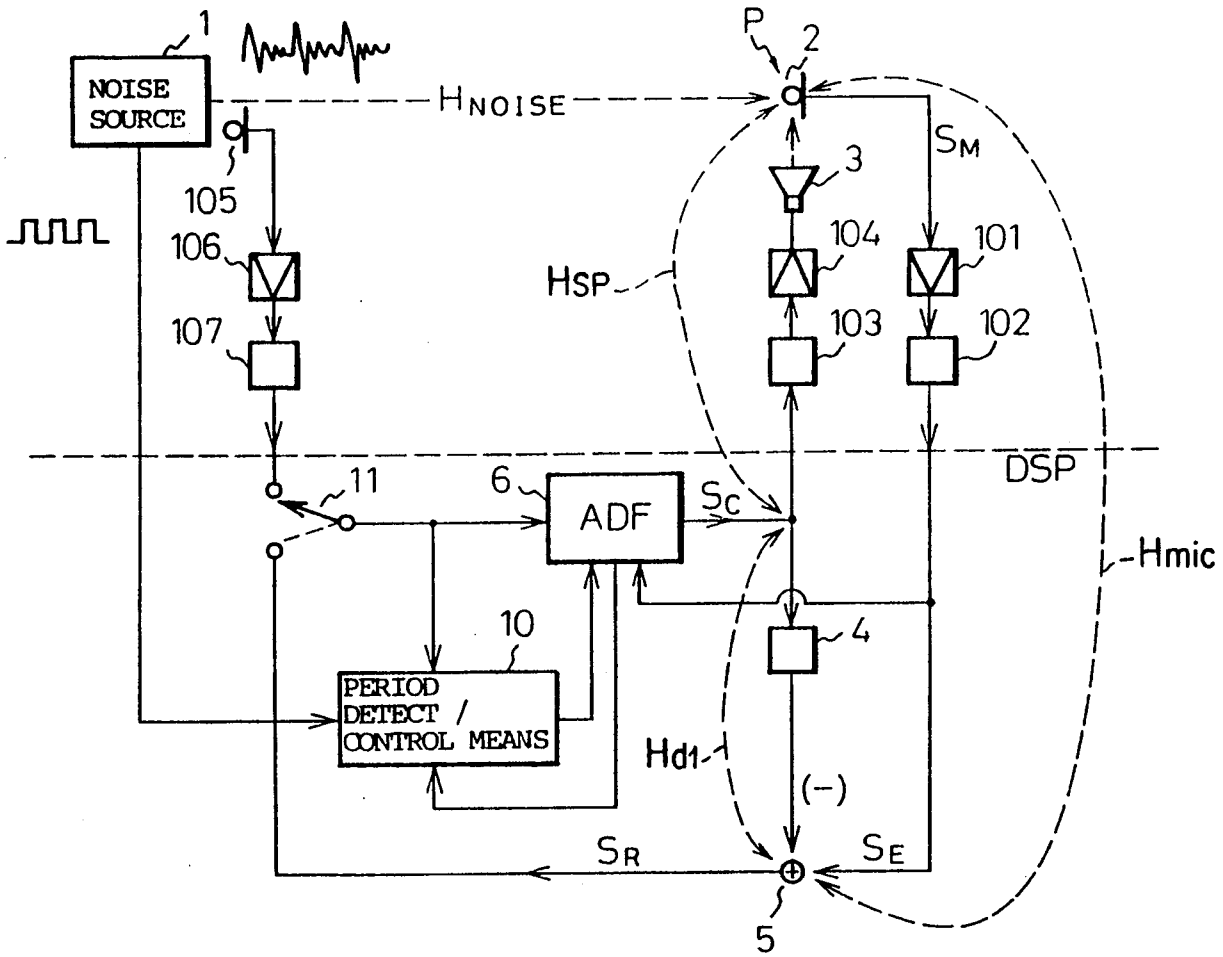
FIG. 12 is a diagram illustrating a noise sound controller according to a fifth embodiment of the present invention.

FIG. 12 is a diagram illustrating a noise sound controller according to a fifth embodiment of the present invention. The constitution of this diagram will now be described.

The noise sound controller shown in this diagram comprises a speaker 3 for erasing a noise from a noise source 1 such as an engine of an automobile near a silencing point P (shown in the drawing), an amplifier 104 for amplifying the output to the speaker 3, a D/A converter (digital to analog converter) 103 that converts a digital signal into an analog signal to feed the analog signal to said amplifier 104, a microphone 2 that converts, into an electric signal, the residual sound after noise from the noise source 1 is erased by the sound wave from the speaker 3, an amplifier 101 that amplifies the electric signal of the microphone 2, an A/D converter (analog to digital converter) 102 that converts an analog signal of the amplifier 101 into a digital signal, an adaptive filtering means 6 that controls the filter coefficient based on a signal from the A/D converter 102 and sends a compensation signal for erasing noise to the speaker 3, a period detect/control means 10 that inputs a timing signal from the noise source 1, inputs a noise signal from a microphone 105 that will be mentioned later or inputs a noise reproduction signal from a differential signal calculation means 5, detects a noise period, estimates a change in the period, and controls the adaptive filtering means 6 depending upon the estimated change in the period so as to be capable of following a sudden change, a microphone 105 installed near the noise source 1, an amplifier 106 that amplifies the output of the microphone 106, an A/D converter 107 that converts an analog output signal of the amplifier 106 into a digital signal, a transfer characteristics simulation means 4 that is connected to the output of the adaptive filtering means 6 and simulates transfer characteristics Hd from the output point thereof up to the input to the differential signal calculation means 5, which will be described later, via speaker 3 and microphone 2, a differential signal calculation means 5 that calculates a differential signal between the output of the transfer characteristics simulation means 4 and the output of the A/D converter 102, and a switching means 11 that alternatively selects the input signal of the adaptive filtering means 6. Here, the adaptive filtering means 6, the period detect/control means 10, etc., are constituted by DSPs (digital signal processors).

Figure 13:
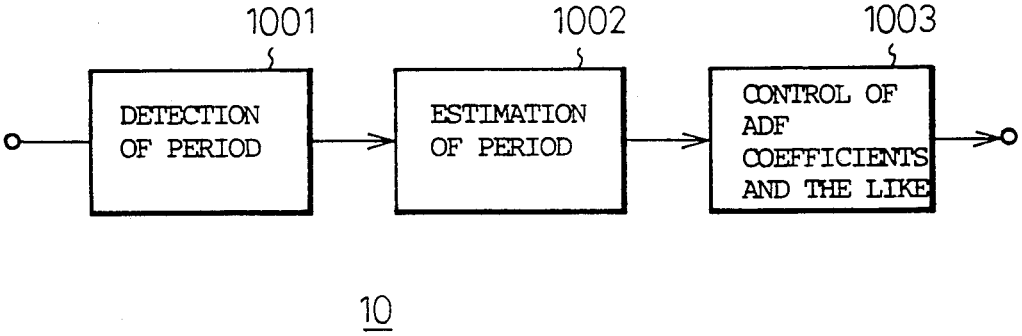
FIG. 13 is a diagram showing the constitution of the period detect/control means of FIG. 12.
Figure 14A:
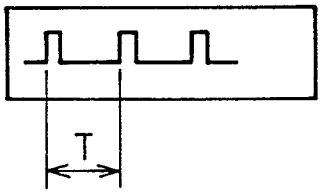
FIG. 14 is a diagram explaining a method of detecting the period by the period detecting unit of FIG. 13.
Figure 14B:
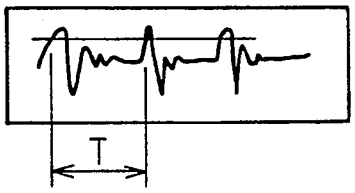
Figure 14C:
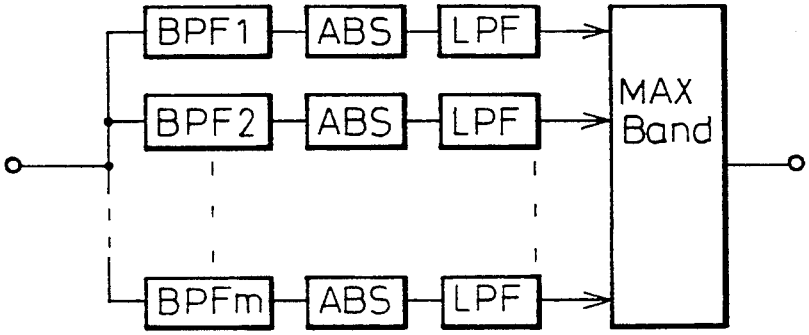
Figure 14D:
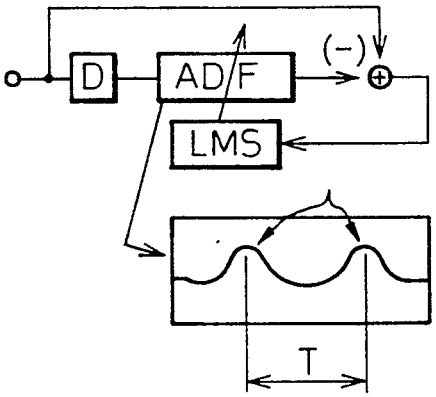

FIG. 13 is a diagram showing the constitution of the period detect/control means of FIG. 12. The period detect/control means 10 shown in this diagram comprises a period detecting unit 1001, a period estimating unit 1002, and a control unit 1003 for controlling coefficients and the like of the adaptive filtering means 6.

FIG. 14 is a diagram explaining a method of detecting the period by the period detecting unit of FIG. 13, wherein the diagram (a) is a method of detecting an ignition timing or a revolution timing (number of revolutions) of an engine or a motor of an automobile that is the noise source 1. Signals of a rectangular waveform are input to the period detecting unit 1001 where a period T thereof is found. The period is then output to the period estimating unit 1002. A sudden change in the noise of an automobile is caused by a change in the number of revolutions or the like of an automotive engine.

The diagram (b) shows a method according to which, when the timing signals shown in the diagram (a) are not obtained, a noise waveform is detected by a microphone or a vibrometer 105 near the engine of the automobile, and a period T of the noise signals is obtained from peaks in the time waveforms thereof. In this signal processing, a rectangular wave is generated when the level of a noise signal has exceeded a predetermined level, thereby obtaining the period T in the same manner as in the diagram (a).

The diagram (c) explains a BPF (band-pass filter) peak detection method for finding a noise period T after a noise signal input to the microphone is digitized. This method comprises a plurality of band-pass filters 1, 2, - - - , n, absolute value units (ABS) connected to the band-pass filters 1, 2, - - - , n, averaging units (LPF) connected to the absolute value units, and maximum band-detecting units that detect maximum values of the averaging units, wherein a maximum frequency band of the noise level is detected and a period of the maximum frequency band is used as a period of a noise signal.

The diagram (d) explains a method of detecting the period using an adaptive filter, comprising a delay unit (delay) that inputs a differential signal $S_R$ from the differential signal calculation means 8, an adaptive filter (ADF) that inputs the output from the delay unit, an adder unit that obtains a differential signal between the output of the adaptive filter and the input signal, and a least-squares processing unit (LMS) that subjects the differential signal of the adder unit to the method of least squares to determine a coefficient of the adaptive filter. The period of a noise signal is found from a coefficient of the adaptive filter.

Figure 15:
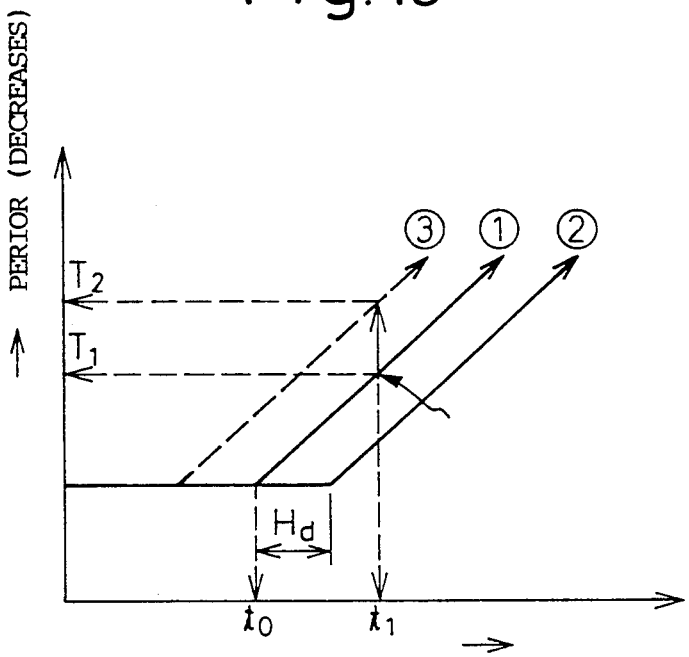
FIG. 15 is a diagram explaining a method of estimating the amount of change in the period.

FIG. 15 is a diagram illustrating a method of estimating the amount of change in the period based on the detected period. If the period first remains constant and then decreases starting at a given moment ($t_0$) as shown in the period estimating unit 1002, the amount of change in the period is detected by the period detecting unit 1001 as represented by (1) in the drawing. According to the prior art, on the other hand, the time is delayed by transfer characteristics Hd as represented by (2) in the drawing at a position of the microphone 2. In order to simplify the description, the transfer characteristics are neglected in the signal processing units such as adaptive filtering means 6 and the like. By taking the transfer characteristics Hd into consideration, the period estimating unit 1002 calculates data to change the period early as represented by a curve (3) in the drawing in contrast with the curve (1). In FIG. 13, a change in the period is represented by a straight line with respect to the time, which, however, may be represented by a curve. In such a case, a function is provided for the curve (3) in the drawing and is found by fitting. In the thus obtained curve (3) of the drawing, an estimated period $T_2$ is found for the period $T_1$ of the present moment ($t_1$). The control unit 103 for controlling coefficients of the ADF and the like of FIG. 13 will be described later.

The adaptive filtering means 6 will now be briefly described. When the differential signal calculation means 5 is selected by the switching means 11, a signal $S_M$ of residual sound expressed by $S_M = S_N \cdot H_{noise} + Sc \cdot Hsp$ is output from the microphone 2 if there holds a relation $Hdl = Hsp \cdot Hmic = Hd$, where $S_N$ denotes noise of the noise source 1, $H_{NOISE}$ denotes transfer characteristics up to the microphone 2, Sc denotes a compensation signal of the adaptive filtering means 6, Hsp denotes transfer characteristics of a system from the adaptive filtering means 6 to the microphone 2 via the speaker 3, Hmic denotes transfer characteristics of a system from the microphone 2 to the differential signal calculation means 5, and Hdl denotes transfer characteristics of the transfer characteristics simulation means 4. Therefore, the differential signal $S_R$, which is a result calculated by the differential calculation unit 5, is given as $S_R = S_M \cdot Hmic - Sc \cdot Hdl = S_N \cdot H_{noise}\ Hmic + Sc \cdot Hsp \cdot Hmic\ - Sc \cdot Hsp \cdot Hmic = S_N \cdot H_{NOISE} \cdot Hmic$; i e., the signal is calculated when the noise only is detected by the microphone 2. Moreover, the output $S_E$ of the A/D converter 102 is given as a control signal for changing the coefficient of the adaptive filter in the adaptive filtering means 6. The adaptive filtering means 6 so changes the coefficient that the control signal becomes zero, and $S_M$ becomes O when $S_E = O$ since $S_E = S_M \cdot Hmic$. Therefore, the differential signal $S_R$ from the differential signal calculation means 5 is input as a signal to be controlled to the adaptive filtering means 6, and the output $S_E$ of the A/D converter 102 is input as a control signal, so that the adaptive filtering means so calculates the compensation signal Sc that $S_E$ becomes zero. When the microphone 105 is selected by the switching means 11, the adaptive filtering means 6 calculates the compensation signal Sc upon receiving a signal from the microphone 105.

Figure 16:
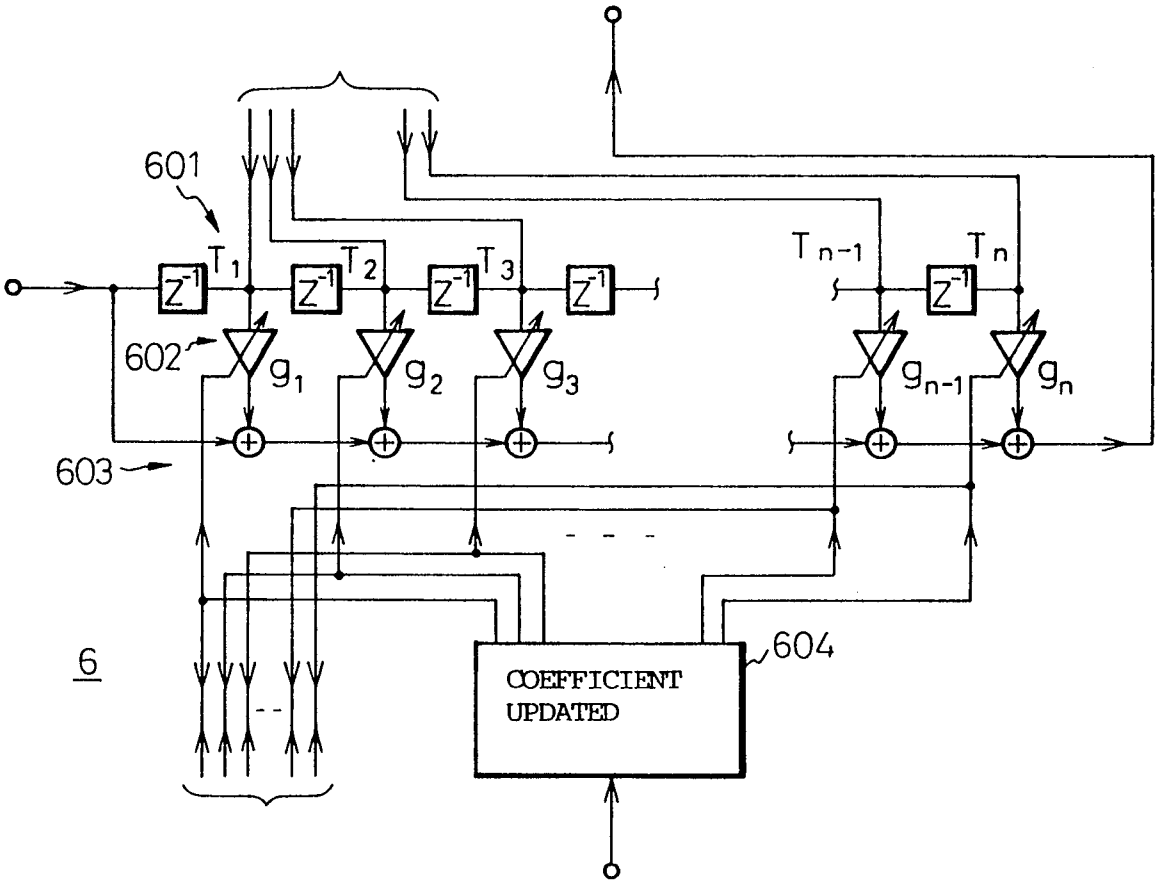
FIG. 16 is a diagram illustrating the adaptive filtering means of FIG. 12.

FIG. 16 is a diagram illustrating the adaptive filtering means that is constituted by non-cyclic filters. Concretely speaking, the adaptive filtering means includes a series of delay units 601 that effect the delay of one sampling period, a plurality of multipliers 602 connected to the delay units 601, a plurality of adders 603 that add up outputs of the multipliers 602, and a coefficient updating means 604 that so controls the multiplication coefficients of the multipliers 602 that the output of the microphone 2 becomes minimal based on the method of least squares.

The series of delay units 601 may be constituted by random access memories (RAMs). In this case, the sampling data that are input are successively shifted to the next address for each sampling, or the values of addresses for inputting the sampling data are successively shifted for each sampling.

Described below is how the multiplication coefficients $g_1, g_2, - - - , g_n$ of the multipliers 602 in the adaptive filtering means 6 shown in FIG. 14 are reset by the control unit 1003 in the period detect/control means 10, which controls coefficients of the ADF.

Figure 17A:
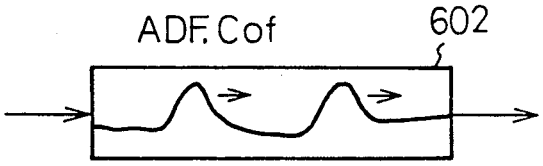
FIG. 17 is a diagram explaining the shifting of multiplication coefficients of a plurality of multipliers that constitute the adaptive filtering means.
Figure 17B:
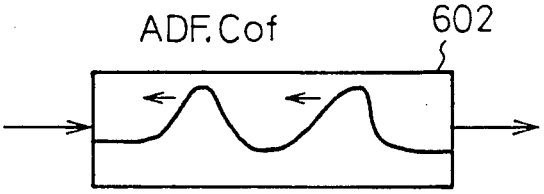

FIG. 17 is a diagram explaining the shifting of multiplication coefficients of the plurality of multipliers that constitute the adaptive filtering, wherein the diagram (a) schematically illustrates signals that pass through the delay unit 601. Usually, multiplication coefficients ($g_1, g_2, - - - , g_n$) of the multipliers 602 are set by signals from the microphone 2. When a change from a short period to a long period is estimated by the period estimating unit 1002, the multiplication coefficients ($g_1, g_2, - - - , g_n$) of the multiplier units 602 are shifted into ($g'_0, g_1, g_2, - - - , g_{n-1}$), - - - , ($g'_{-8}, g'_{-7}, - - - , g'_0, g_1, g_2, - - - , g_{n-9}$) i.e., shifted toward the n-th multiplier (delay unit) by the control unit 1003, which controls coefficients of the ADF. Therefore, the delay amount increases and the period can be lengthened.

In the diagram (b) contrary to the above-mentioned case, when a change from a long period to a short period is estimated by the period estimating unit 1002, the multiplication coefficients ($g_1, g_2, - - - , g_n$) of the multipliers 602 are shifted into ($g_2, g_3, - - - , g_n, g'_{n+1}$), - - - , ($g_{10}, g_{11}, - - - , g_n, g'_{n+1}, g'_{n+2}, - - - , g'_{n+9}$), - - - , i.e., shifted toward the O-th multiplier (delay unit) by the control unit 1003, which controls coefficients of the ADF. Therefore, the delay amount decreases and the period can be shortened. Here, however, g' can be selected to be any optimum value (e.g., 0).

Figure 18A:
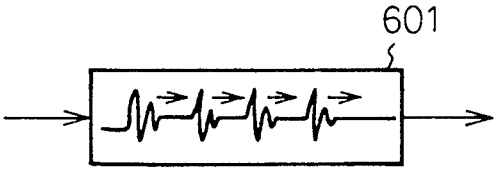
FIG. 18 is a diagram explaining the tap moving of a plurality of delay units that constitute the adaptive filtering means.
Figure 18B:
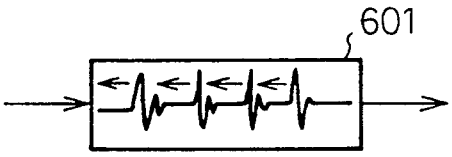

FIG. 18 is a diagram explaining the tap moving of the delay units that constitute the adaptive filtering means, which is a modification of FIG. 15. In the diagram (a), in general, the taps ($T_1$, $T_2$, - - - , $T_n$) of the delay units 601 are set. When a change from a short period to a long period is estimated by the period estimating unit 1002, however, the taps ($T_1$, $T_2$, - - - , $T_n$) are shifted into ($T'_0$, $T_1$, $T_2$, - - - , $T_{n-1}$), - - - , ($T'_{-10}$, - - - , $T'_{-1}$, $T'_0$, $T_1$, $T_2$, - - - , $T_{n-9}$), - - - , i.e., shifted toward the n-th delay unit by the control unit 1003, which controls coefficients of the ADF. Therefore, the delay amount increases and the period can be lengthened.

In the diagram (b) contrary to the above-mentioned case, when a change from a long period to a short period is estimated by the period estimating unit 1002, the taps ($T_1$, $T_2$, - - - , $T_n$) of the delay units 601 are shifted into ($T_2$, $T_3$, - - - , $T_n$, $T'_{n+1}$), - - - , ($T_{10}$, $T_{11}$, - - - , $T_n$, $T'_{n+1}$, $T'_{n+2}$, - - - , $T'_{n+9}$), - - - , i.e., shifted toward the O-th multiplier by the control unit 1003, which controls coefficients of the ADF. Therefore, the delay amount decreases and the period can be shortened. Here, however, T' may be any optimum value (e.g., 0).

Figures 19A, 19B, 19C:
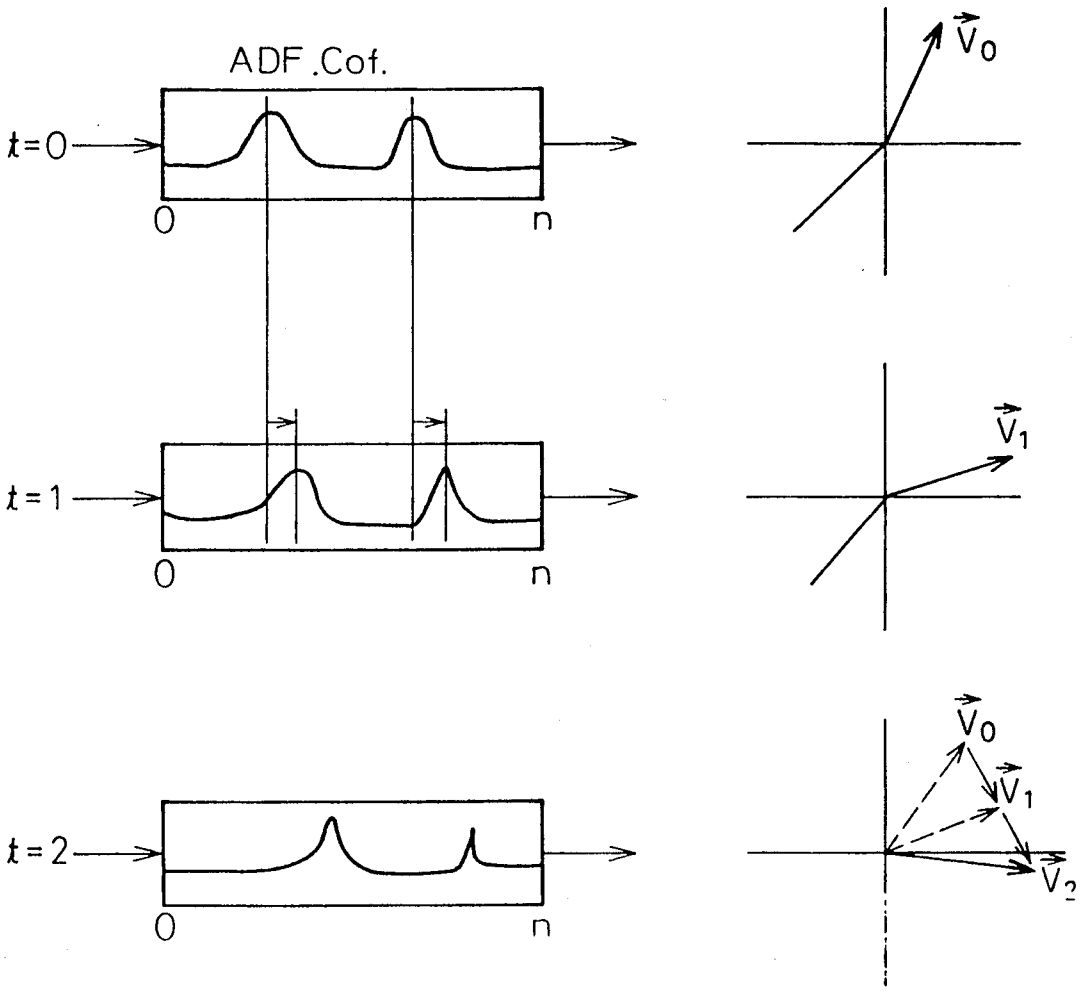
FIG. 19 is a diagram illustrating a modified example of the period detect/control means of FIG. 12.

FIG. 19 is a diagram illustrating a modified example of the period detect/control means of FIG. 12. The period detecting unit 1001 in the period detect/control means 10 inputs the multiplication coefficients of the multipliers 602 of the adaptive filtering means 6 and forms the following n-dimensional vector.

$$\overline{V(t)}=g_1(t)\cdot\overline{i_1}+g_2(t)\cdot\overline{i_2}+\ldots+g_n(t)\cdot\overline{i_n}$$

The adaptive filtering means 4 successively updates the multiplication coefficients ($g_1$, $g_2$, - - - , $g_n$) as shown in the diagrams (a), (b) and (c), and the period estimation unit 1002 traces the vector like t=0, 1, 2, - - - to estimate the vector after a time t. Based on this estimation, multiplication coefficients ($g_1$, $g_2$, - - - , $g_n$) are found from the vector and are set to the multipliers 602 by the control unit 1003, which controls coefficients of the ADF. Thus, the filtering characteristics of the adaptive filtering means 6 can be changed by changing the multiplication coefficients of the multipliers 602 that are included in the adaptive filtering means 6 or by moving the output taps of the delay units 601.

According to the present invention as described above, a noise period of a noise source is detected and the period is controlled in an estimated manner based on the characteristics of the noise period. Therefore, even a sudden change in frequency can be followed.

INDUSTRIAL APPLICABILITY

The present invention can be advantageously applied to a digital signal processor for canceling a noise sound of engines, motors and the like.

I claim:

1. A noise sound controller outputting a compensation sound to cancel a noise sound generated from a noise source, the compensation sound having a phase opposite to a phase of the noise sound and a sound pressure equal to a sound pressure of the noise sound, the noise sound controller comprising:

sound wave-electric signal means for trapping, near a silencing point, a residual sound remaining after canceling the noise sound with the compensation sound and for converting the residual sound into an electrical signal as an error signal;

electric signal-sound wave means for outputting said compensation sound;

adaptive filtering means for updating a plurality of filter coefficients and for obtaining said compensation sound based on said error signal, said adaptive filtering means outputting a compensation signal;

transfer characteristics simulation means provided at an output of said adaptive filtering means for simulating transfer characteristics of a system from an output of said adaptive filtering means to a point returning as said error signal passing through said electric signal-sound wave means and said sound wave-electric signal means;

differential signal calculation means for calculating a differential signal between the compensation signal output from said adaptive filtering means through said transfer characteristics simulation means and said error signal from said sound wave-electric signal means, said differential signal calculation means outputting a reproduction noise signal;

period-detecting means for measuring a noise period of the noise source; and period-adjusting means for varying a delay period of an output signal from said differential signal calculation means depending upon an amount of change of said noise period.

2. The noise sound controller of claim 1, wherein said period-detecting means detects the noise period from the reproduction noise signal of said differential signal calculation means.

3. A noise sound controller outputting a compensation sound to cancel a noise sound generated from a noise source, the compensation sound having a phase opposite to a phase of a noise sound and a sound pressure equal to a sound pressure of the noise sound, the noise sound controller comprising:

sound wave-electric signal means for trapping, near a silencing point, a residual sound remaining after canceling the noise sound with the compensation sound and for converting the residual sound into an electrical signal as an error signal;

electric signal-sound wave means for outputting said compensation sound;

adaptive filtering means for updating a plurality of filter coefficients and for obtaining said compensation sound based on said error signal, the adaptive filtering means outputting a compensation signal;

first period detecting/control means for measuring a noise period of said noise source, for estimating a change in the noise period, and for changing the plurality of filter characteristics of said adaptive filtering means depending on the estimated change in the noise period, the first period detecting/control means including:

period detecting means for measuring the noise period of said noise source, period estimating means for estimating a sudden change in the noise period; and second control means for lengthening the noise period when a change from a short period to a long period is estimated by the period estimating means and for shortening the noise period when a change from the long period to the short period is estimated by the period estimating means.

4. The noise sound controller of claim 3, wherein said second control means controls the plurality of filter coefficients of said adaptive filtering means, the control means increasing a delay amount in response to the period estimating means estimating the change from the short period to the long period and decreasing the delay amount in response to the period estimating means estimating the change from the long period to the short period.

5. The noise sound controller of claim 3, wherein said first period detecting/controlling means measures the noise period of said noise source, estimates a change of the noise period, and moves a plurality of output taps of a plurality of delay units included in said adaptive filtering means depending on the estimated change in the noise period.

6. The noise sound controller of claim 3, wherein said first period detecting/controlling means forms a vector of a plurality of dimensions, detects a change in the vector, estimates the change in the vector, and sets a multiplication coefficient of a plurality of multipliers included in said adaptive filtering means in response to the detected change in the vector.

* * * * *